US009192967B2

(12) United States Patent
Suarez et al.

(10) Patent No.: US 9,192,967 B2
(45) Date of Patent: Nov. 24, 2015

(54) MODULAR RECYCLER AND PARTS WASHER APPARATUS

(75) Inventors: Carlos R. Suarez, Miami, FL (US); Christopher Hiatt, Smyrna, GA (US)

(73) Assignee: SystemOne Technologies, Inc., Miami, FL (US)

( * ) Notice: Subject to any disclaimer, the term of this patent is extended or adjusted under 35 U.S.C. 154(b) by 998 days.

(21) Appl. No.: 13/178,716

(22) Filed: Jul. 8, 2011

(65) Prior Publication Data

US 2012/0006365 A1 Jan. 12, 2012

Related U.S. Application Data

(60) Provisional application No. 61/399,248, filed on Jul. 8, 2010.

(51) Int. Cl.
*B08B 3/04* (2006.01)
*B08B 3/00* (2006.01)

(52) U.S. Cl.
CPC ..... *B08B 3/006* (2013.01)

(58) Field of Classification Search
CPC ..... B08B 3/006; B08B 3/14; B08B 3/04
USPC ..... 134/109
See application file for complete search history.

(56) References Cited

U.S. PATENT DOCUMENTS

| | | | | |
|---|---|---|---|---|
| 5,660,248 | A * | 8/1997 | Velisavljevic | 187/237 |
| 5,827,374 | A * | 10/1998 | Mansur | 134/12 |
| 2004/0159597 | A1* | 8/2004 | Lee | B01D 17/00 210/167.29 |
| 2005/0199267 | A1* | 9/2005 | Oakes | 134/10 |
| 2008/0314417 | A1* | 12/2008 | Porter et al. | 134/34 |

* cited by examiner

*Primary Examiner* — Jason Ko
*Assistant Examiner* — Spencer Bell
(74) *Attorney, Agent, or Firm* — Robert M. Downey, P.A.

(57) ABSTRACT

A compact, modular and fully integrateable apparatus for recycling volatile cleaning solvents which can be utilized independently as a stand-alone recycler unit in conjunction with any typical parts washer apparatus (e.g., sink-on-a-drum or immersion type units) in common use. The core modular recycler component can also be fully integrated with a wash basin component and a docking base that is specifically designed to be docked to standard drums containing cleaning solvent, thereby providing a fully integrated recycler/parts washer apparatus that has a significantly reduced footprint. The core modular recycler component includes an outer housing surrounding a distillation chamber with heaters, a condenser and cooling fan, a vacuum/fluid pump, a clean distillate reservoir and a residue discharge port. Periodically, during continuous recycling operations, batches (e.g., 1 to 2 gallons) of contaminated cleaning solvent are transferred from the drum to the core recycler component to remove contaminants and produce clean solvent that is returned to the drum for further use in parts washing operations.

7 Claims, 6 Drawing Sheets

MODULAR RECYCLER AND PARTS WASHER APPARATUS

This application is based on provisional patent application Ser. No. 61/399,248, filed on Jul. 8, 2010.

BACKGROUND OF THE INVENTION

1. Field of the Invention

The present invention relates to a modular apparatus for recycling cleaning solvents used to wash parts with modular add-on components to provide for a fully integrated recycler/parts washer.

2. Discussion of the Related Art

During maintenance, repair and rebuilding operations in virtually all industrial and commercial environments, it is necessary to wash a wide variety of parts and articles in order to remove grease, oil, dirt and other contaminants. Typically, volatile solvents are used in almost all small parts cleaning operating as they have been found to be most effective in removing grease and other accumulated residue from metal parts and other articles. A well known and widely used means for washing automotive, aviation, marine, industrial and general parts, components and tools during service, maintenance, repair, rebuilding operations etc. involves using a sink-on-a-drum apparatus in which a sink basin is placed on top of and installed to a drum containing a cleaning solvent (e.g. a 16 or 30 gallon drum). A pump is provided which pumps the solvent from the drum to a spigot in the sink basin, where the solvent is used to rinse and clean parts. The solvent then leaves the sink basin and returns to the drum (along with any contaminants removed from the parts). The contaminated solvent is continuously used (and therefore becomes more and more contaminated) during cleaning operations until it is eventually replaced with a clean drum of solvent (e.g. on a monthly basis). The method for replacing the drum involves manually lifting the sink basin off of the drum, replacing the drum with a new drum, and then reinstalling the sink basin on the new drum. The contaminated drum of solvent must then be taken away and disposed of in a manner complying with EPA contaminant disposal guidelines.

The conventional sink-on-a-drum apparatus has two major drawbacks. First, the volatile solvent in the drum becomes progressively contaminated as it is used more and more, and by the time the drum is replaced, the solvent has become so contaminated that it is less effective as a cleaning agent and inefficient to use by mechanics and other workers. Second, the method of replacing the drum can be unsafe and hazardous because service personnel who replace drums can injure themselves (e.g., back injury) while lifting the heavy sink basins off of and onto the drums. This results in the filing of worker's compensation claims that can be very costly to solvent service providers.

In light of the shortcomings associated with the prior art, there remains a need for an apparatus for recycling cleaning solvent and for washing parts which allows for an easier and safer method of replacing a solvent-containing drum.

OBJECTS AND ADVANTAGES OF THE INVENTION

Considering the foregoing, it is a primary object of the present invention to provide a modular, compact apparatus for integrating with a solvent-containing drum and which continuously recycles the solvent in the drum.

It is a further object of the present invention to provide a modular, compact apparatus which can be utilized independently as a stand-alone recycler unit in conjunction with any typically used parts washer apparatus including sink-on-a-drum and immersion type units in common use.

It is yet a further object of the present invention to provide a modular recycler unit that can also be utilized as a fully integrated recycler/parts washer with the simple attachment of add on components designed to complement the core recycler apparatus, including a wash basin in various dimensions and a rolling base designed specifically to be "docked" to standard drums of various sizes used as the solvent reservoir.

It is a further object of the present invention to provide a modular recycler/parts washer apparatus, as described above, which allows for easy, quick, and safe replacement of a solvent-containing drum.

It is a further object of the present invention to provide a modular recycler/parts washer apparatus, as described above, which allows for automatic priming on first use and which further provides the first gallon of distillate within two hours of commencing the recycle operation.

It is still a further object of the present invention to provide a modular recycler/parts washer apparatus, as described above, which provides a continuous flow of clean distillate throughout the recycle process utilizing latent heat in the distillation tank of the recycler unit to eliminate heating cycle times on sequential batches, reduce energy requirements and increase operating efficiency.

It is still a further object of the present invention to provide a modular recycler/parts washer apparatus, as described above, which can be connected to any size drum, any standard sink-on-drum parts washers, immersion style solvent washers or as part of an all-in-one fully integrated recycler/parts washer.

It is still a further object of the present invention to provide a modular recycler/parts washer apparatus, as described above, which has an integrated switched output that can be used to control the wash pump and/or light fixture of a traditional sink-on-a-drum parts washer or immersion style solvent washer and/or provide for an automatic off timer to reduce evaporative waste and energy usage.

It is still a further object of the present invention to provide a modular recycler/parts washer apparatus, as described above, which reduces the occurrence of injuries among workmen and thereby reduces the amount of workman's compensation claims for back injuries caused by removing and reinstalling heavy sink basins.

It is still a further object of the present invention to provide a modular recycler/parts washer apparatus, as described above, which recycles a batch of approximately 1 to 2 gallons of contaminated solvent per hour.

It is still a further object of the present invention to provide a modular recycler/parts washer apparatus, as described above, which extends the useful service life of the cleaning solvent thereby reducing the frequency of services required for the removal and replacement of contaminated cleaning solvent (e.g., from about once per month to about once per 2 to 3 months or longer).

It is still a further object of the present invention to provide a modular recycler/parts washer apparatus, as described above, which allows service providers to replace fewer drum or other solvent reservoirs, increases worker productivity and allots more time for other functions such as sales and customer service.

These and other objects and advantages of the present invention are more readily apparent with reference to the detailed description and accompanying drawings.

SUMMARY OF THE INVENTION

The present invention is directed to a compact, modular and fully integrateable recycler/parts washer apparatus allowing for the safe and efficient integration of various separate modular components for washing automotive, aviation, marine, industrial and general parts, components and tools during service, maintenance, repair and rebuilding operations. The apparatus comprises a modular recycler component, a modular wash basin component, a modular rolling docking base component and a modular interconnect component. The apparatus is designed specifically for integration with universal cleaning-solvent reservoirs (e.g. solvent-containing drums).

The core apparatus is a modular recycler unit for recycling volatile cleaning solvents which can be utilized independently as a stand-alone recycler unit in conjunction with any typically used parts washer apparatus including sink-on-a-drum or immersion type units in common use. The core modular recycler unit can also be utilized as a fully integrated recycler/parts washer with the simple attachment of add on components designed to complement the core recycler apparatus including a wash basin in various dimensions and a rolling base designed specifically to be "docked" to standard drums of various size that are used as the solvent reservoir. The recycler parts washer apparatus is designed to eliminate the unsafe and hazardous methods of replacing drums of contaminated solvent on commonly used sink-on-a-drum type units by the manual lifting off of a heavy sink basin placed on top of the drum, replacing the drum and manually reinstalling the sink basin. By contrast, the recycler/parts washer apparatus of the present invention is designed to easily roll away from the drum. The drum can then be replaced with a new drum wherein the apparatus can roll back and dock the drum to the base of the apparatus. Drums can be docked either at the rear of the apparatus or on either side of the apparatus. The design of the recycler/parts washer apparatus serves to eliminate the commonly used practice of lifting off of heavy sink basins while providing the additional advantages of an integrated recycler/parts washer with a significantly reduced footprint as compared to commonly used parts washers in conjunction with separate recycler apparatuses. The core modular recycler unit serves to continually recycle the cleaning solvent by heating the solvent to produce vapors; the vapors pass through a condenser where it is cooled to a liquid state yielding clean solvent and then directed back into the drum for re-use. Contaminants are removed through a discharge port.

The wash basin component is mounted above the recycler component and has a wide, rectangular-shaped sink-like area. A pump is connected to a conduit leading to the solvent reservoir and brings cleaning solvent up to a spigot and/or a nozzle and brush in the basin. Cleaning solvent leaves the basin through a drain which is connected to a conduit that leads back to the solvent reservoir (e.g., solvent-containing drum).

The recycler unit comprises a distillation chamber with heaters, a condenser with a fan, a distillate reservoir, a vacuum/fluid pump and a residue discharge port. During operation, individual batches of contaminated solvent are pumped from the solvent reservoir directly to the distillation chamber where the contaminated solvent is heated. The heating process serves to separate the contaminants from the clean solvent. Clean solvent becomes a vapor that is directed to the condenser where the vapor is cooled and transformed back into a liquid state. The liquid solvent is then pumped back into the solvent reservoir for continued use. The contaminants remain in a solid/liquid form and may be later removed through a residue discharge port.

A semi-circular groove or cut-out in the rolling docking base allows for compact fitting and integration of the recycler/parts washer apparatus with the solvent reservoir to thereby reduce the overall footprint of the integrated apparatus and reservoir.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Throughout the several views of the drawings, the present invention is shown and is generally indicated as 10.

Figure 1:
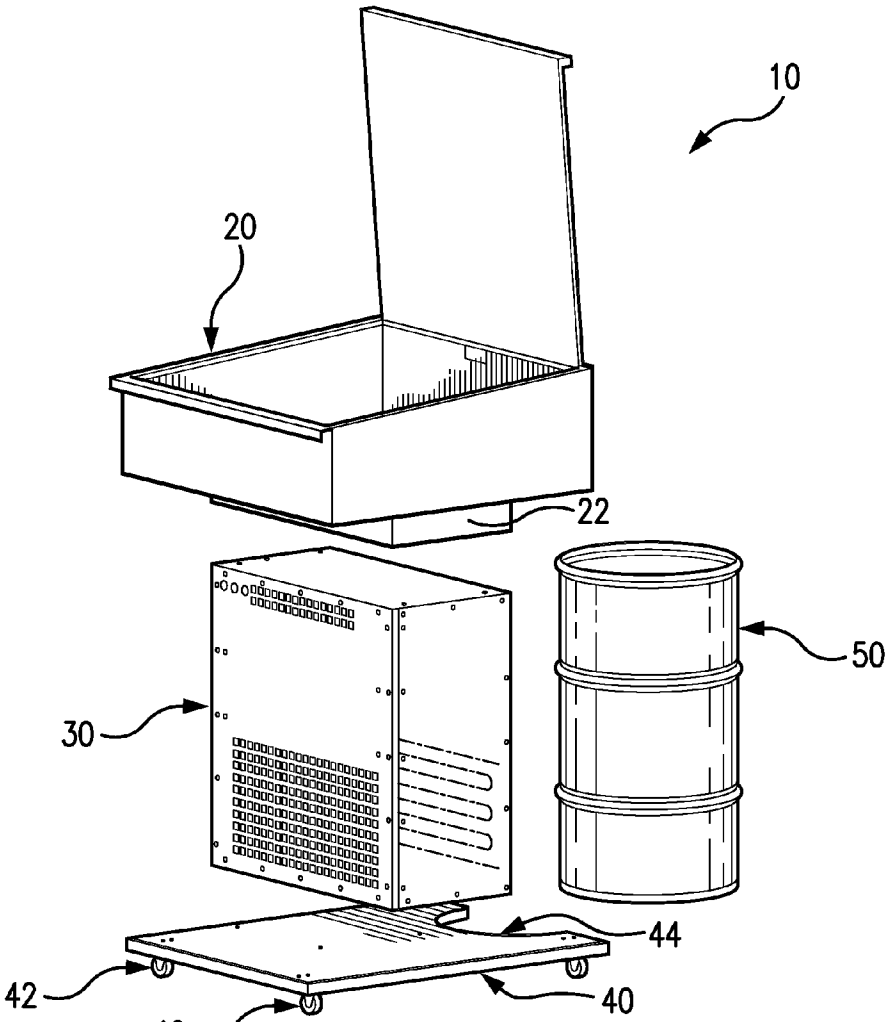
FIG. 1 is an exploded perspective view of the principal components of the modular recycler and parts washer apparatus of the present invention.

Turning to the drawings, FIG. 1 illustrates a first preferred embodiment of the modular recycler and parts washer apparatus of the present invention 10, shown in an exploded view. The principal components of the present invention 10 are a wash basin 20, a core recycler component 30, and a docking base 40. These principal components integrate with a solvent reservoir 50 (e.g. a solvent-containing drum).

Figure 2:
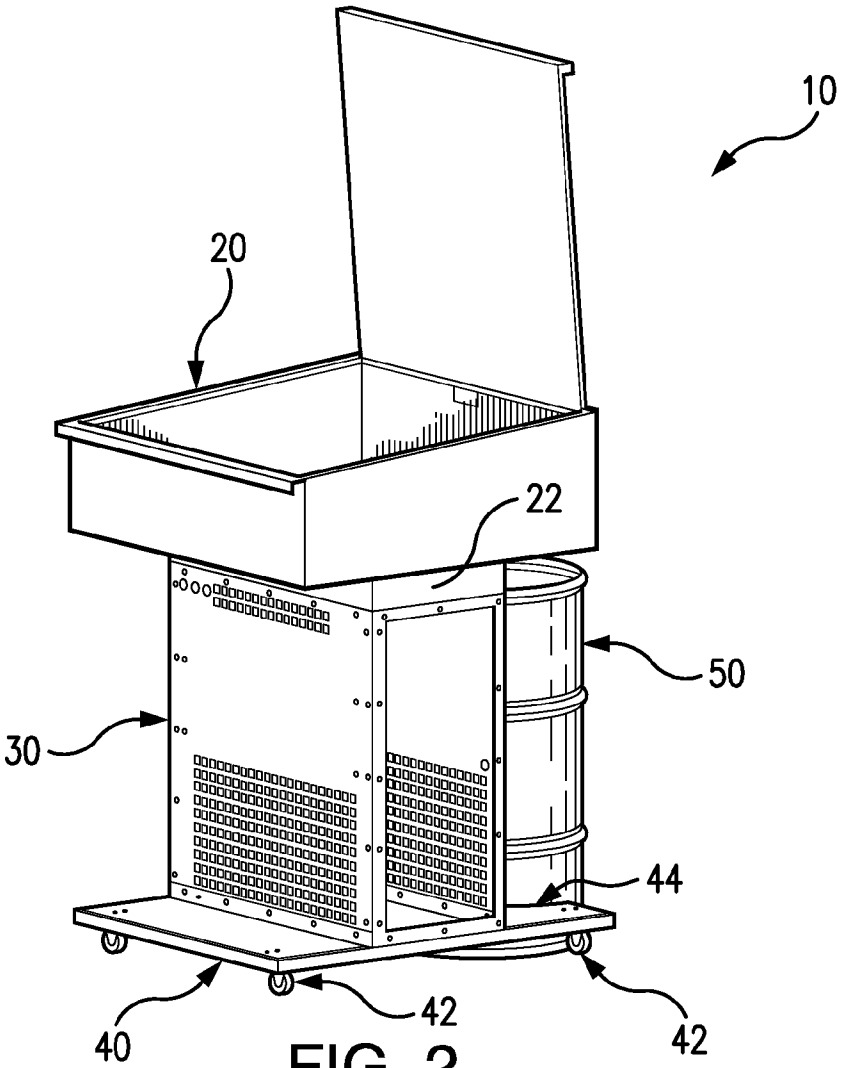
FIG. 2 is a perspective view of the assembled apparatus according to first embodiment of the present invention.
Figure 3:
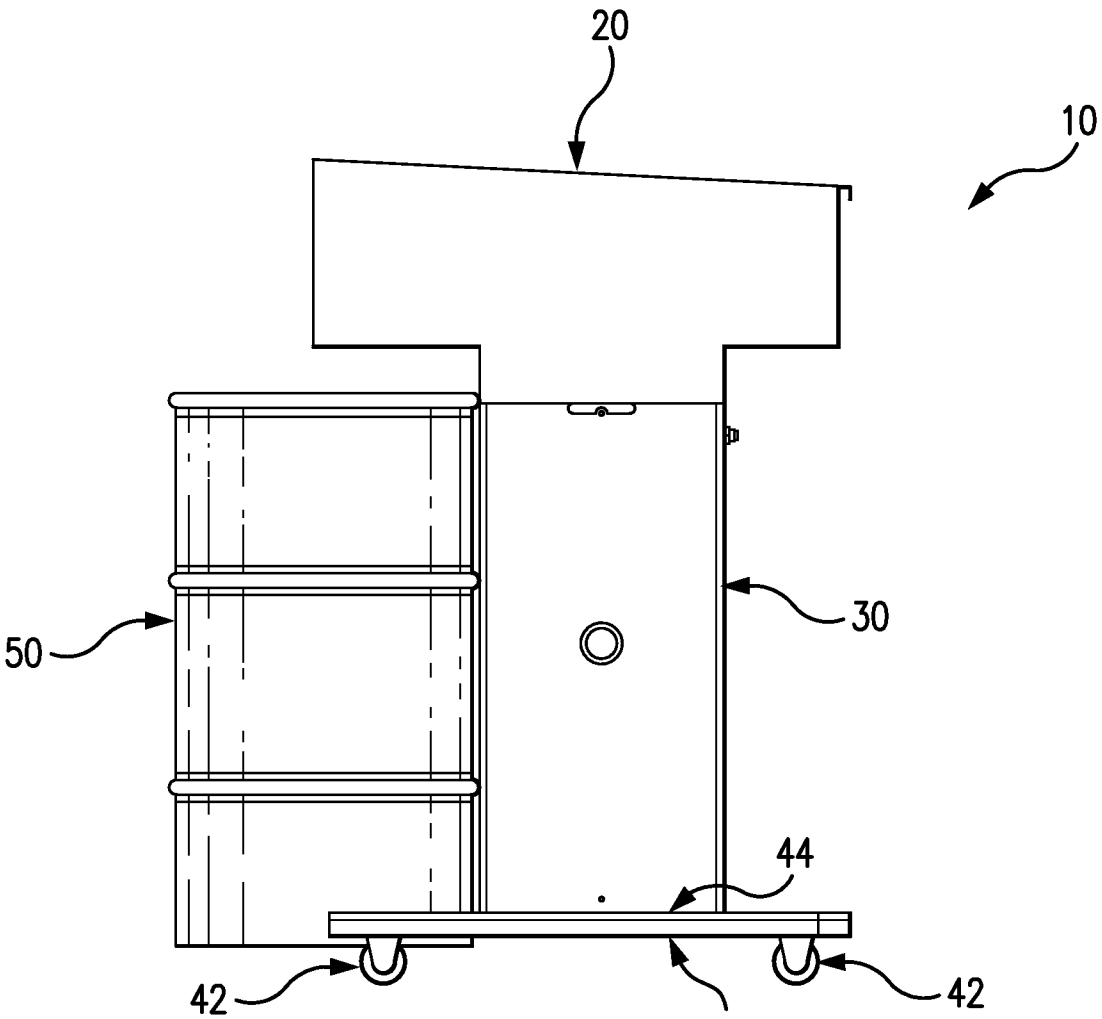
FIG. 3 is a side elevational view of the assembled apparatus of the first embodiment of the present invention.
Figure 4:
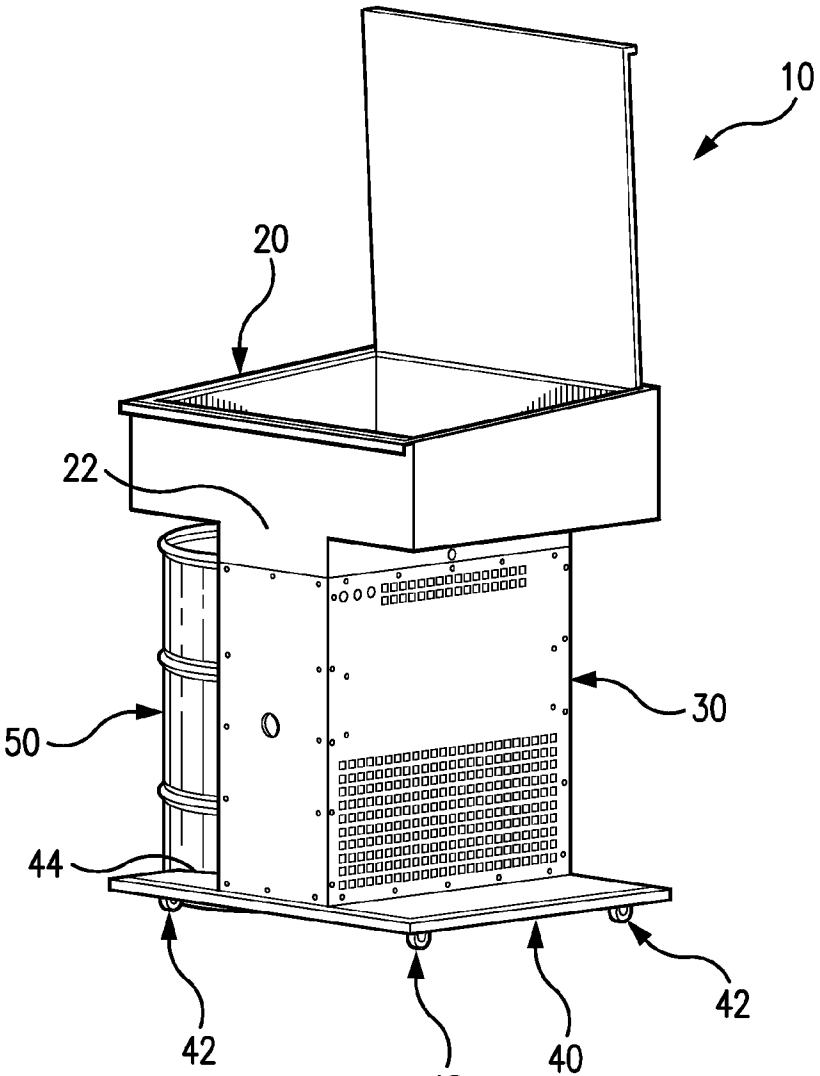
FIG. 4 is a perspective view of the assembled apparatus according to a second embodiment of the present.

Referring to FIGS. 2 and 3, the principle components of the apparatus 10 are shown assembled together as a combined unit and integrated with the solvent reservoir 50. The core recycler component 30 includes an outer housing 30, and an arrangement of inner components including a distillation chamber 34, heaters or heating elements 35 within the distillation chamber, a condenser 38 and cooling fan 39, a vacuum/fluid pump 60, a clean distillate reservoir 62 and a residue discharge port 37. The wash basin 20 has a rectangular shoulder 22 that is structured and disposed to rest on and connect to the core recycler component 30, as seen in FIGS. 2-4. The core recycler component 30 can be removably mounted onto the top of the docking base 40, as seen in FIGS. 2-4. Attachment of the wash basin 20 to the core recycler unit 30 and mounting of the core recycler unit to the docking base 40 can be achieved with the use of conventional hardware such as screws, bolts or clips, or other fastening members that allow for easy and convenient attachment and separation of the three principle components of the apparatus 10.

The docking base 40 is fitted with a plurality of wheels 42, attached to underside of the docking base to allow for ease of mobility of the assembled apparatus 10 in relation to the solvent reservoir 50. The docking base 40 has a semi-circular groove or cut-out area 44 which is shaped to neatly receive the solvent reservoir 50 so that the solvent reservoir 50 is positioned close to the housing of the core recycler component 30, as seen in FIGS. 2-3 according to a first preferred embodiment, and in FIG. 4 according to a second preferred embodiment of the invention. This semi-circular groove 44 allows the solvent reservoir 50 to dock with the assembled apparatus 10 as a compact, integrated unit that has a significantly reduced footprint compared to commonly used parts washers in conjunction with separate recycler units. Initially, the solvent reservoir 50 is placed in the desired location of a facility for solvent recycling and/or parts washing operations. Once the solvent reservoir 50 is at the desired location, the assembled apparatus 10 can be conveniently rolled into place, using the wheels 42 of the docking base 40, while making sure that the solvent reservoir 50 is received into the groove 44, as seen in FIGS. 2-3, also in FIG. 4.

The second preferred embodiment of the present invention is shown in FIG. 4 wherein the solvent reservoir 50 is docked to the apparatus 10 along the side of the assembled apparatus 10. Primary differences of the second preferred embodiment include the 90 degree rotation of the rectangular shoulder 22 of the wash basin 20 and the shift in location of the semi-circular groove 44 which, in this second preferred embodiment, is located along the side edge of the docking base 40 rather than the rear edge. Method of integration of the components of the apparatus 10 and the solvent reservoir 50 and operation of the apparatus of the second preferred embodiment is essentially identical to the first preferred embodiment.

Figure 5:
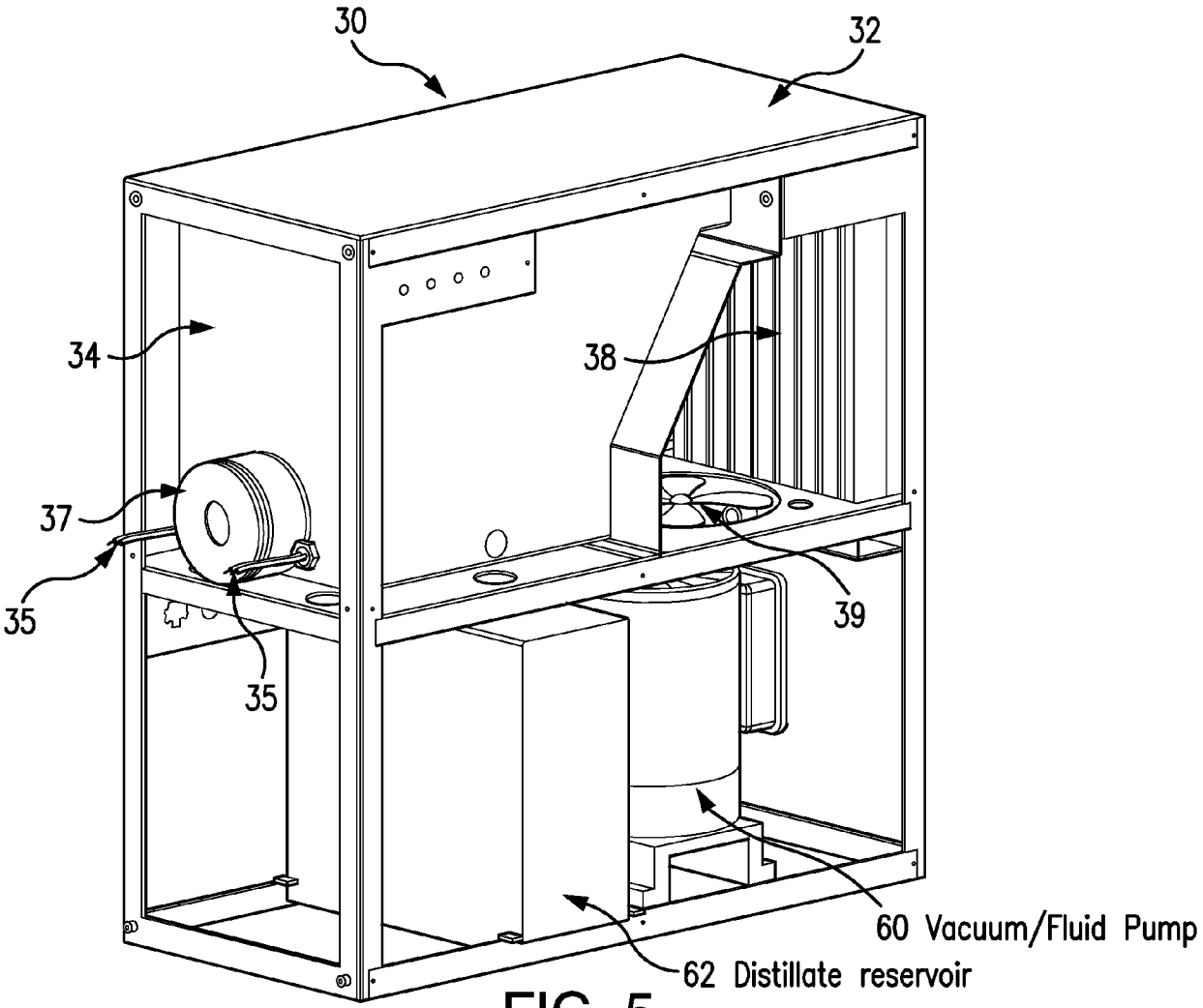
FIG. 5 is a perspective view revealing the internal components of the core recycler component of the present invention.

FIG. 5 is a more detailed perspective view of the core recycler component 30 which reveals the inner components. The outer housing 32 surrounds the inner components, including the distillation chamber 34. Contaminated solvent that is delivered to the core recycler component 30 from the reservoir 50 first enters into the distillation chamber 34. During the distillation cycle, the contaminated solvent is heated by heater 35 to cause separation of clean solvent from the contaminants. This is achieved by producing vapors, wherein the clean solvent separates from the contaminants in the form of vapors which are then delivered to the condenser 38. The contaminants remain in the distillation chamber 34 in liquid and/or solid form and are eventually removed through the residue discharge port 37. In the condenser, where the vapors are cooled by the fan 39 to produce a liquid distillate yielding pure (i.e., non-contaminated) cleaning solvent. The clean solvent is then directed to the clean distillate reservoir 62. Vacuum/fluid pump 60 is used to transfer the clean solvent from the distillate reservoir 62 back to the reservoir 50.

Figure 6:
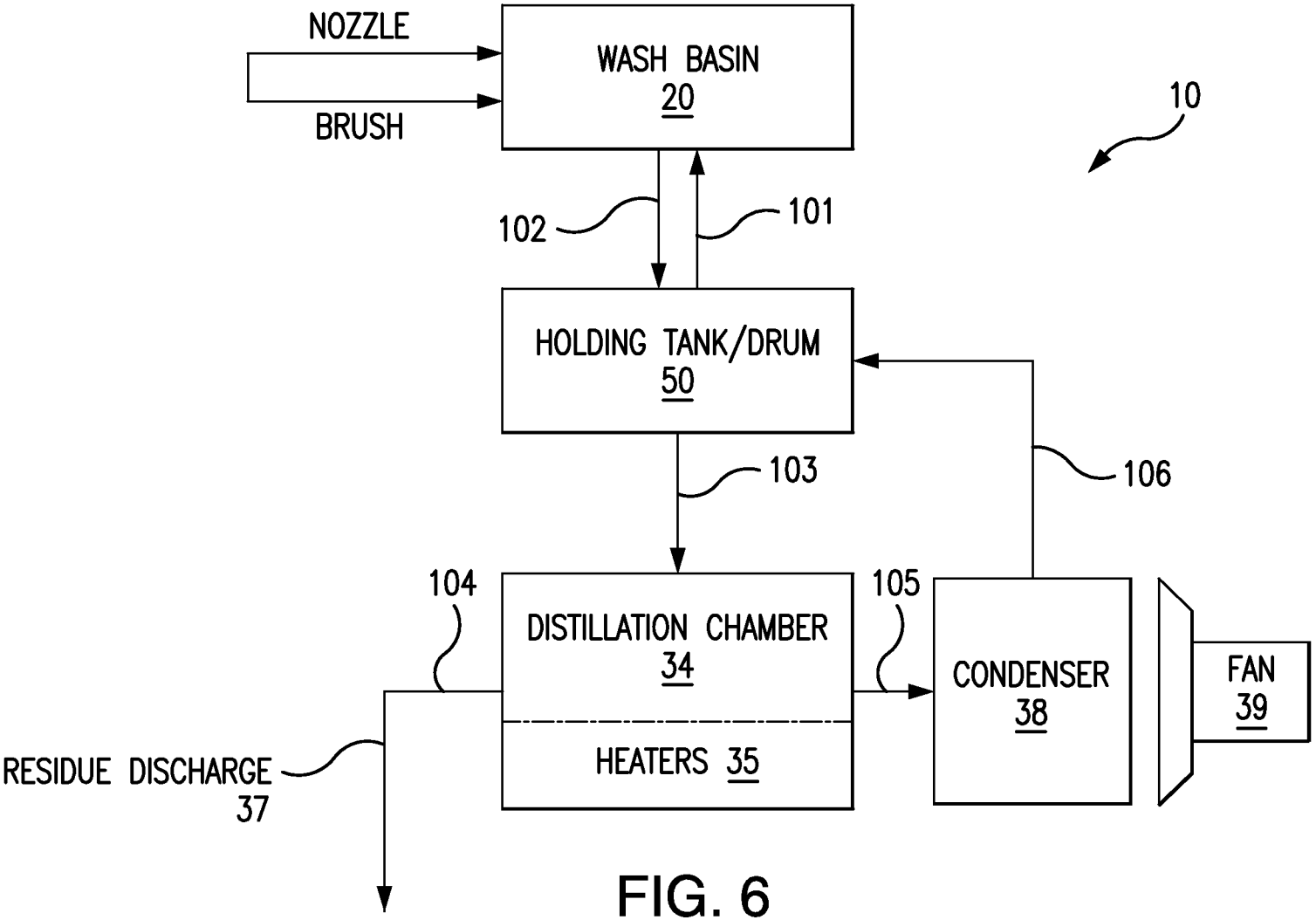
FIG. 6 is a schematic diagram illustrating the sequence of operations of the present invention according to the preferred embodiment.

FIG. 6 is a schematic diagram illustrating the preferred operations of the modular recycler and parts washer apparatus 10 of the present invention. In step 101, cleaning solvent is pumped from the reservoir 50 to the wash basin 20 where it is used to clean parts, components and tools. The solvent is then delivered back to the solvent reservoir 50 in step 102. Periodically, during continuous recycling operations, a batch (e.g., 1 to 2 gallons) of the partially contaminated cleaning solvent in the reservoir 50 (e.g., drum) is pumped from the reservoir to the distillation chamber 34 of the core recycler component 30, as indicated by step 103. Within the distillation chamber 34, the contaminated or partially contaminated cleaning solvent is heated by heaters 35 to cause the solvent to vaporize, as described above. The contaminants are removed from the apparatus through the residue discharge port 37 in step 104. The solvent vapor is transferred to the condenser in step 105 where the vapor is cooled and converted back into a liquid form with the use of cooling fan 39. In step 106, the clean liquid solvent, contained in the clean distillate reservoir, is pumped back to the solvent reservoir 50 where it may be again used to clean parts, components and tools. During continuous operations, partially contaminated batches of solvent are removed from the solvent reservoir 50 for recycling, and recycled cleaned batches of solvent are replaced back into the solvent reservoir 50, thereby prolonging the useful service life of the solvent and reducing the frequency of solvent reservoir (e.g., drum) removal and replacement.

While the present invention has been shown in accordance with several preferred and practical embodiments, it is recognized that departures from the instant disclosure are fully contemplated within the spirit and scope of the present invention which are not to be limited except as defined in the following claims as interpreted under the Doctrine of Equivalents.

What is claimed is:

1. A modular recycler and parts washer apparatus comprising:

a reservoir for containing a cleaning solution and the reservoir defined by a stationary container having a bottom that rests on a floor surface and a vertical side wall structure extending up from the bottom to a top, and the vertical side wall structure having an exterior surface with an exterior surface contour;

a recycler unit structured for receiving contaminated cleaning solution from the reservoir and producing non-contaminated, recycled cleaning solution, and the recycler unit including an outer housing surrounding an arrangement of internal recycler components including a pump for transferring the non-contaminated, recycled cleaning solution to the reservoir;

a wash basin for receiving the cleaning solution from the reservoir in order to wash parts, components, tools and other articles therein, and said wash basin being structured and disposed for removable mounting on a top of the recycler unit so that an overhang portion of the wash basin extends horizontally out beyond the recycler unit;

a horizontally planar docking base having a flat top side, a bottom side, at least one side edge, and a plurality of wheels for allowing rolling transport of the docking base on a floor surface, and the recycler unit being mounted on the flat top side of the docking base as a combined integral assembly comprising the docking base, the recycler unit and the wash basin, and the at least one side edge having a cut-out area defined by at least one vertical surface that is shaped to be congruent with the exterior surface contour of the side wall structure of the reservoir, and the cut-out area being sized, structured and configured for congruent nested receipt of the vertical side wall structure of the reservoir therein to ensure alignment of the reservoir relative to the docking base and recycler unit in a reproducible operable position with a portion of the top of the reservoir tucked under the overhang portion of the wash basin and a remaining portion of the top of the reservoir exposed outwardly beyond the overhang portion of the wash basin to allow ease of access thereto; and wherein the combined integral assembly of the docking base, the recycler unit and the wash basin can be transported on the floor surface and moved into position with the reservoir, while the reservoir remains stationary, so that the reservoir is received within the cut-out area and docked in the operable position with the combined integral assembly of the docking base, the recycler unit and the wash basin as a compact, integrated apparatus.

2. The modular recycler and parts washer apparatus as recited in claim 1 further comprising:

a residue discharge port on the recycler unit for allowing removal of contaminants from within the reorder unit.

3. The modular recycler and parts washer apparatus as recited in claim 2 wherein the docking base further includes a front side edge, a rear side edge, and opposite left and right side edges.

4. The modular recycler and parts washer apparatus as recited in claim 3 wherein the cut-out area is formed along one of the front and rear edges.

5. The modular recycler and parts washer apparatus as recited in claim 3 wherein the cut-out area is formed along one of the left and right side edges.

6. The modular recycler and parts washer apparatus as recited in claim 1 further comprising:

a clean distillate reservoir for receiving the non-contaminated, recycled cleaning solution.

7. A modular recycler and parts washer apparatus comprising:

a reservoir for containing a cleaning solution and the reservoir defined by a stationary container having a bottom that rests on a floor surface and a vertical side wall structure extending up from the bottom to a top, and the vertical side wall structure having an exterior surface with an exterior surface contour;

a recycler unit structured for receiving contaminated cleaning solution from the reservoir and producing non-contaminated, recycled cleaning solution, and the recycler unit including an outer housing surrounding an arrangement of internal recycler components including a pump for transferring the non-contaminated, recycled cleaning solution to the reservoir;

a wash basin mounted on a top of the recycler unit and being structured for receiving the cleaning solution from the reservoir in order to wash parts, components, tools and other articles therein, and said wash basin including an overhang portion that extends horizontally out beyond the recycler unit;

a horizontally planar docking base having a top side, a bottom side, at least one side edge, and a plurality of wheels for allowing rolling transport of the docking base on a floor surface, and the recycler unit being mounted on the top side of the docking base as a combined integral assembly comprising the docking base, the recycler unit and the wash basin, and the at least one side edge having a cut-out area that is shaped to be congruent with the exterior surface contour of the side wall structure of the reservoir, and the cut-out area being sized, structured and configured for congruent nested receipt of the vertical side wall structure of the reservoir therein to ensure alignment of the reservoir relative to the docking base and recycler unit in a reproducible operable position with a portion of the top of the reservoir tucked under the overhang portion of the wash basin and a remaining portion of the top of the reservoir exposed outwardly beyond the overhang portion of the wash basin to allow ease of access thereto; and wherein the combined integral assembly of the docking base, the recycler unit and the wash basin can be transported on the floor surface and moved into position with the reservoir, while the reservoir remains stationary, so that the reservoir is received within the cut-out area and docked in the operable position with the combined integral assembly of the docking base, the recycler unit and the wash basin as a compact, integrated apparatus.

* * * * *